United States Patent [19]

Kawaguchi

[11] Patent Number: 4,458,891

[45] Date of Patent: Jul. 10, 1984

[54] PAPER FEEDER

[75] Inventor: Shoichi Kawaguchi, Toride, Japan

[73] Assignee: Komori Printing Machinery Co., Ltd., Tokyo, Japan

[21] Appl. No.: 354,105

[22] Filed: Mar. 2, 1982

[30] Foreign Application Priority Data

Mar. 4, 1981 [JP] Japan ..... 56-30780
Mar. 4, 1981 [JP] Japan ..... 56-30782

[51] Int. Cl.[3] ..... B65H 3/40
[52] U.S. Cl. ..... 271/93; 271/98
[58] Field of Search ..... 271/91, 92, 93, 98, 271/107, 11, 14, 30 R, 31, 103; 414/121

[56] References Cited

U.S. PATENT DOCUMENTS 3,931,964 1/1976 Schwebel ..... 271/93
3,937,457 2/1976 Schwebel ..... 414/121 X

FOREIGN PATENT DOCUMENTS 967058 8/1964 Fed. Rep. of Germany ..... 271/98
51-7404 3/1976 Japan .
753426 7/1956 United Kingdom ..... 271/30 R
1385601 2/1975 United Kingdom ..... 271/91

*Primary Examiner*—Bruce H. Stoner, Jr.
*Assistant Examiner*—Lisa M. Rosenberg
*Attorney, Agent, or Firm*—Remy J. VanOphem

[57] ABSTRACT

A paper feeder including a sucker frame, a separation suction device mounted on the sucker frame and substantially vertically movable for picking up stacked sheets one at a time, and a transport suction device mounted on the sucker frame and substantially horizontally movable for transferring the picked-up sheet from the separation suction device. The separation suction device includes a hollow guide nozzle supported on the sucker frame and tiltable in a back-and-forth direction and an orthogonal direction, a hollow intermediate nozzle telescopically fitted over the guide nozzle and resiliently urged to move downwardly, the hollow intermediate nozzle having a flange, a hollow suction nozzle telescopically fitted over the intermediate nozzle and resiliently urged to move downwardly, the hollow suction nozzle being operatively coupled to the intermediate nozzle and including a bottom having a suction port, an adjusting mechanism interposed between the sucker frame and the guide nozzle for tilting the guide nozzle to adjust angles of inclination thereof in the back-and-forth and orthogonal directions, a guide member vertically movably supported on the sucker frame and vertically restricting the flange of the intermediate nozzle, and a cam mechanism mounted on the sucker frame and operable in synchronization with the separation and transport suction devices, the guide member being limited in its vertical position by the cam mechanism.

3 Claims, 10 Drawing Figures

PAPER FEEDER

BACKGROUND OF THE INVENTION

The present invention relates to a paper feeder for use in printing machines which includes a separation suction device vertically movable for sucking one sheet at a time from sheets stacked on a stacking table and a transport suction device for feeding the sucked sheet horizontally into the printing machine.

Machines for handling sheets of paper, such as sheet-fed presses and sheet folding machines, include a paper feeder for drawing sheets of paper one at a time from a stack on a stacking table and feeding each sheet in the forward direction into the machine. Such known paper feeders include separation suction devices which are vertically movable, for sucking one sheet at a time, transport suction devices forwardly movable for feeding the picked-up sheet, an air blower for shuffling several uppermost sheets, and a probing foot for separating the sucked sheet from a next lower sheet on the sheet stack. The separation suction devices have suction nozzles which are positionally adjusted in advance so as to be inclined with respect to the direction of feed and a direction transverse thereto, and are upwardly movable in a direction at an angle to the vertical direction, so that the separation suction devices can correct the orientation of the sheet and keep the latter taut while moving upwardly. Such adjustment is time-consuming and requires a skillful operation and is normally repeated several times before proper adjustment is achieved, and results in an unwanted downtime of the printing machine. A device has been proposed for adjusting the separation suction devices while the printing machine is in operation. The proposed device, however, is large in size and complicated, cannot effect smooth adjustment, and tends to allow the separation suction devices to move unstably.

Complete paper feeding requires that the uppermost sheet be readily separated from the lower sheet, the picked-up sheet be removed easily from the suction nozzle when sucked by the transport suction devices, and various parts be moved smoothly to keep up with high-speed operation. Prior paper feeders, however, have failed to meet these requirements.

The probing foot is vertically adjustable to detect the level of the topmost sheet for adjusting the distance between the suction nozzle and the topmost sheet. Such an adjusting operation requires complete shutdown of the paper feeder device, and is tedious and time-consuming. The probing foot adjustment sometimes involves height adjustment of the paper feeder device to avoid poor sheet shuffling, resulting in a more complex adjusting procedure. According to an alternative arrangement, the separation suction devices are movable vertically relative to the level of the uppermost sheet. However, such adjustment also results in a downtime of the paper feeder and is time-consuming.

SUMMARY OF THE INVENTION

It is a principal object of the present invention to provide a paper feeder having an improved sheet feeding performance.

Another object of the present invention is to provide a paper feeder capable of reliable sheet separation upon sucking up of an uppermost sheet from a stack of sheets of paper.

Still another object of the present invention is to provide a paper feeder which can discharge a sheet of paper reliably from the suction devices.

A still further object of the present invention is to provide a paper feeder which requires a simple adjustment procedure for an improved paper feeding efficiency.

A still further object of the present invention is to provide a paper feeder which will effect smooth sheet sucking and transferring operations for high-speed paper feeding.

A paper feeder includes a sucker frame, a separation suction device mounted on the sucker frame and being substantially vertically movable for picking up stacked sheets one at â time, and being a transport suction device mounted on the sucker frame and being substantially horizontally movable for transferring the picked-up sheet from the separation suction device. The separation suction device includes a hollow guide nozzle supported on the sucker frame and tiltable in a back-and-forth direction and an orthogonal direction, a hollow intermediate nozzle telescopically fitted over the guide nozzle and resiliently urged to move downwardly, the hollow intermediate nozzle having a flange, a hollow suction nozzle telescopically fitted over the intermediate nozzle and resiliently urged to move downwardly, the hollow suction nozzle being operatively coupled to the intermediate nozzle and including a bottom having a suction port, an adjusting mechanism interposed between the sucker frame and the guide nozzle for tilting the guide nozzle to adjust angles of inclination thereof in the back-and-forth and orthogonal directions, a guide member vertically movably supported on the sucker frame and vertically restricting the flange of the intermediate nozzle, and a cam mechanism mounted on the sucker frame and operable in synchronization with the separation and transport suction devices, the guide member being limited in its vertical position by the cam mechanism.

The adjusting mechanism adjusts the angles of inclination of the separation suction device, and the cam mechanism limits vertical positional limits for the separation suction device, such that the picked-up sheet can be controlled to correct its orientation while the paper feeder is in operation. The suction nozzle is movable upwardly in two stepped motions while it is limited positionally by the guide member, and is movable downwardly under the resiliency of springs. This arrangement allows the picked-up sheet to fly up easily away from the stacked sheets, and to be separated readily from the separation suction device while being transferred to the transport suction device. The cam mechanism includes a cam lever which is eccentrically journalled in the sucker frame, and means for angularly moving the cam lever to adjust vertical positional limits for the separation suction device. The distance between the separation suction device and the topmost sheet on the stack of sheets is varied by moving only the separation suction device while the paper feeder is being operated.

The above and other objects, features, and advantages of the present invention will become more apparent from the following description when taken in conjunction with the accompanying drawings in which certain preferred embodiments are shown by way of illustrative example.

BRIEF DESCRIPTION OF THE DRAWINGS

FIG. 9(*b*) is a fragmentary cross-sectional view showing the lever shaft of FIG. 8 journalled in a frame side wall.

DETAILED DESCRIPTION

Figure 1:
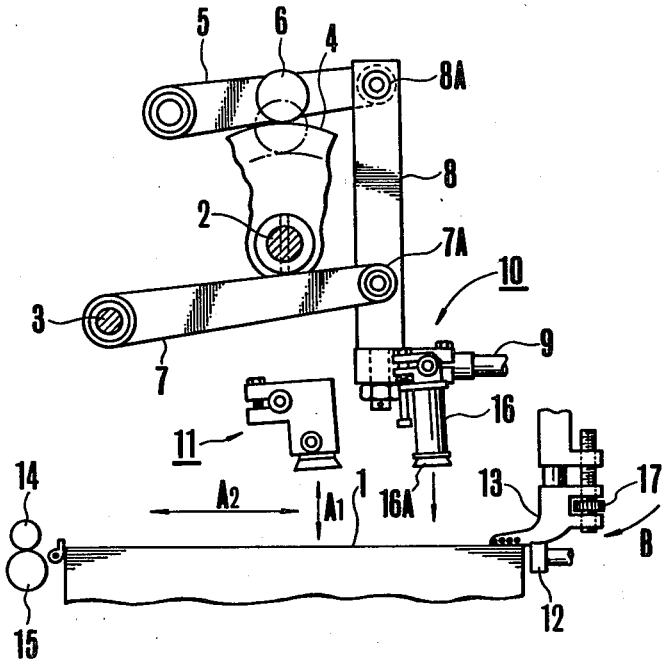
FIG. 1 PRIOR ART
FIG. 1 is a side elevational view of a conventional paper feeder device.

A conventional paper feeder as shown in FIG. 1 includes a cam shaft 2 and a lever shaft 3 supported by and extending between frame members (not shown) in overlying relation to a stacked pile of sheets of paper 1 on a table (not illustrated). The cam shaft 2 has a cam 4 against which there is held a cam follower 6 rotatably mounted on a swingable cam lever 5. A support lever 7 has one end secured to the lever shaft 3 and an other end 7A, to which there is pivotably attached a vertical lever 8 having an upper end 8A pivotably mounted on one end of the cam lever 5. The vertical lever 8 supports on its lower end a pair of separation suction devices 10, only one of which is shown, spaced apart from each other in a direction normal to sheet of drawing and coupled to a source of vacuum through air hoses 9. A pair of transport suction devices 11, only one of which is illustrated, are disposed forward of the separation suction devices 10 and drivable by a non-illustrated driver to move upwardly and downwardly, and back and forth in the directions of the arrows A1 and A2. An air blower 12 and a probing foot 13 are positioned adjacent to trailing edges of the stacked sheets 1. A pair of timing and transport rollers 14, 15 which are vertically held against each other, are located adjacent to leading edges of the piled sheets 1. The probing foot 13 has a detector (not shown) for detecting the topmost sheet on the sheet stack to keep the topmost sheet at a constant level at all times by raising the stacker table through operation of an automatic table lifter (not shown). A stream of air is continuously discharged from the air blower 12 against the trailing edges of several upper sheets to facilitate separation thereof.

When the cam shaft 2 rotates to cause the cam 4 to turn about the cam shaft 2 until a smaller-diameter portion of the cam 4 (indicated by the dot-and-dash line) reaches the cam follower 6, the separation suction devices 10 are moved downwardly to bring lower open ends 16A of suctions nozzles 16 of the separation suction devices 10 into contact with the uppermost sheet 1, whereupon a vacuum is developed in the suction nozzles 16 by drawing air through the air hoses 9 to attract the uppermost sheet 1 to the lower open ends 16A of the suction nozzles 16. Then, the separation suction devices 10 are lifted with the sheet 1 carried thereon, and the probing foot 13 moves in the direction of the arrow B into a space defined between the lifted sheet and a next sheet below. At this time, air is ejected from the probing foot 13 into the space as the probing foot 13 holds down the pile of sheets 1. The picked-up sheet 1 is then attracted to the transport suction devices 11, whereupon the vacuum to the separation suction devices 10 is deactivated and the latter start descending. The transport suction devices 11 move forward to take the sheet 1 away from the separation suction devices 10. When the leading edge of the sheet 1 is inserted between the timing and transport rollers 14, 15, the vacuum to the transport suction devices 11 is deactivated and the latter are retracted to release the sheet 1, allowing the sheet 1 to be fed along by the timing and transport rollers 14, 15. One cycle of the paper feeding operation is completed when the separation and transport suction devices 10, 11, respectively return to their starting positions.

The sheets 1 sometimes tend to be skewed slightly out of alignment as they are stacked on the table, and it is necessary to correct the sheets 1 out of possible skewed orientation while they are transferred from the separation suction devices 10 to the transport suction devices 11. The separation suction devices 10 are required to keep the sheet 1 taut widthwise thereof (in a direction normal to the sheet of the drawing) since stacked sheets 1 would lie in the path of movement of the probing foot 13 as the latter advances. To meet these requirements, the suction nozzles 16 are slightly inclined with respect to the direction of feed of the sheets 1 and a direction transverse thereto, and are movable upwardly in a direction at an angle to the vertical direction, so that the sheets 1 are corrected to have a proper orientation and tensioned by the separation suction devices 10 while the latter are ascending. Although adjustment of the angle of inclination of the suction nozzles 16 should preferably be made while observing the way the sheet 1 is picked up by the separation suction devices 16, the prior art paper feeder shown in FIG. 1 requires that the paper feeder, and hence an associated printing machine, be shut down for such adjustment, resulting in an undesirable downtime. The adjusting procedure should be repeated to make a proper adjustment, and hence is tedious and time-consuming, and needs to be carried out by a skilled operator.

A proposed adjusting device is secured to the frame for enabling an adjusting process to be effected during operation of the paper feeder. The adjusting device, however, is large in size and complicated in mechanism, and fails to adjust the parts smoothly because of interference between adjusting movements in the back-and-forth direction and the orthogonal direction. Where the adjustment device is insufficiently fixed to the frame, the separation suction devices are likely to move unstably due to vibrations of the printing machine.

For a complete paper feeding operation, it is additionally necessary that the topmost sheet be readily separated from the lower sheet, the picked-up sheet be removed easily from the suction nozzles 16 of the separation suction devices 10 when transferred to the transport suction devices 11, and the feeder parts be in smooth operation to meet demands for high-speed performance. No prior paper feeders satisfy the foregoing requirements completely, and hence fail to perform the desired paper feeding operation.

The distance between the separation suction device 10, particularly the suction nozzles 16 thereof and the topmost sheet 1, needs to be adjusted or changed dependent on the grade and thickness of paper handled, to avoid poor suction on the sheets 1 and flying of the sheets 1 which would otherwise result from setting of an improper distance between the suction device 10 and the upper surface of the piled sheets 1. Such an adjustment is carried out by rotating an adjustment screw 17 to change the level of the probing foot 13 and hence the level at which the uppermost sheet 1 is detected by the probing foot 13. To adjust the adjustment screw 17, the paper feeder is required to be stopped since the probing foot 13 moves to and fro at all times during operation. A few sheets of paper 1 need to be fed out on a trial basis to see if a proper adjustment has been made. Where sheets 1 are not fed out as desired upon such trial feeding, another adjusting procedure must be repeated. Furthermore, different adjustment processes should be employed to cope with low-speed and high-speed modes of paper feeding operation. The prior adjusting procedure is therefore tedious and time-consuming. When the level of the uppermost sheet 1 changes, the timing and transport rollers 14, 15 are liable to fail to grip the sheet 1 properly because of a varied distance in a vertical sense between the sheet 1 and the rollers. As a result the sheets 1 may not be completely shuffled since the air blower 12 and a brush and a leaf spring (which are not shown) are vertically displaced with respect to the stacked sheets 1. Accordingly, the adjustment of the probing foot 13 should be accompanied by the adjustment of height of other parts of the paper feeder. As an alternative, the separation suction devices 10 may be adjustable vertically by stopping operation of the paper feeder and loosening nuts, a process which is time-consuming, laborious and wastes an increased number of sheets of paper upon adjustment.

Figure 2:
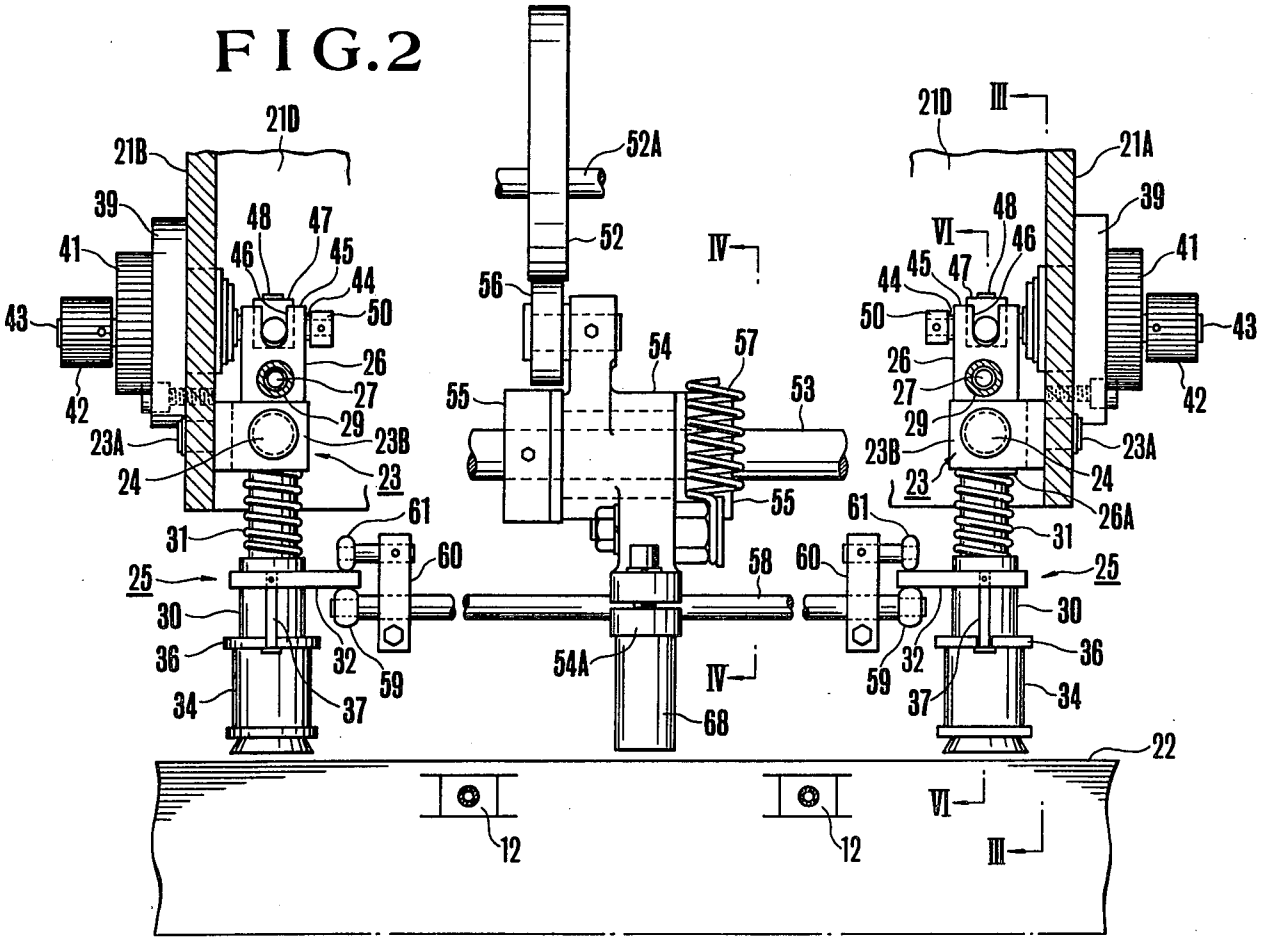
FIG. 2 is a front elevational view of a paper feeder device according to the present invention.
Figure 3:
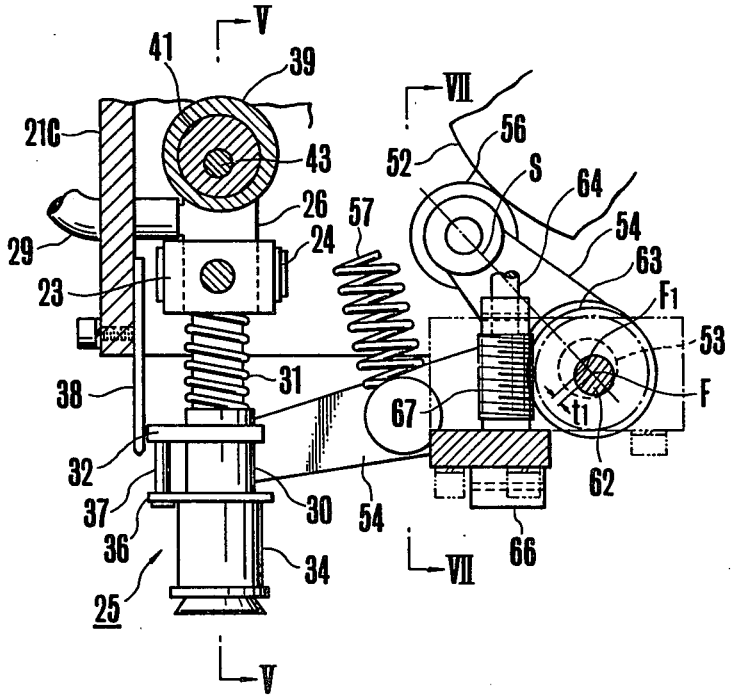
FIG. 3 is a cross-sectional view taken along line III—III of FIG. 2.
Figure 4:
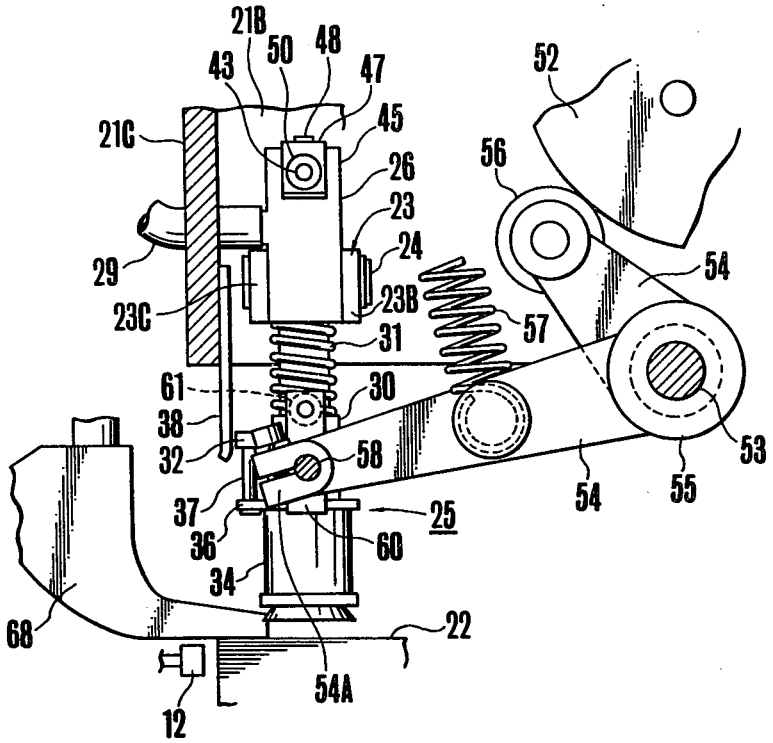
FIG. 4 is a cross-sectional view taken along line IV—IV of FIG. 2.
Figure 5:
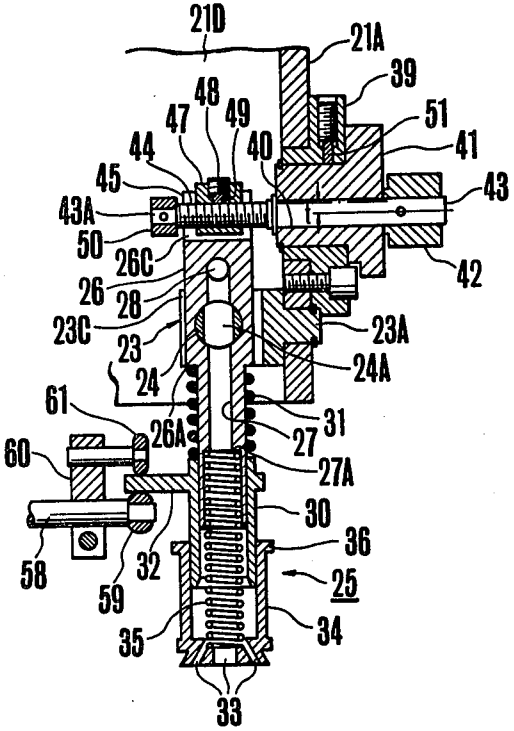
FIG. 5 is a cross-sectional view taken along line V—V of FIG. 3.

According to an embodiment of the present invention, as shown in FIGS. 2 through 4, a paper feeder for use with printing machines, paper folding machines or the like includes a suction head frame structure or sucker frame 21 of an elongated configuration, which is positionally adjustable back and forth with respect to the frame (not shown) of a printing machine or similar device with which the paper feeder is used. The sucker frame 21 has open upper and lower ends disposed upwardly of a pile of sheets 22 of paper stacked on a stacker table (not shown), and a pair of side walls 21A, 21B spaced from each other widthwise of the stacked sheets 22. Each of the side walls 21A, 21B has a nozzle support 23 in the form of a fork or a U having a central projection 23A rotatably mounted on the side wall 21A or 21B at its lower and rear position. The nozzle support 23 has a pair of spaced arms 23B, 23C between which extends a pin 24 supporting thereon a guide nozzle 26 of a separation suction device 25, the guide nozzle 26 being angularly movable about the pin 24. As shown in FIG. 5, the guide nozzle 26 has a central bore 27 communicating with a central hole 24A in the pin 24 and opening at a lower end of the guide nozzle 26. The central bore 27 has an upper branch 28 disposed upwardly of the pin 24 and coupled to an air hose 29 (FIG. 6) connected to a source of vacuum (not shown) through the sucker frame 21. An intermediate cylindrical nozzle 30 is telescopically fitted over a lower portion of the guide nozzle 26 and is normally urged downwardly by an outer compression coil spring 31 disposed around the guide nozzle 26 and acting between a shoulder or step 26A of the guide nozzle 26 and an upper end of the intermediate cylindrical nozzle 30. The intermediate cylindrical nozzle 30 has a flange 32 extending laterally and sandwiched between an upper guide 61 and a lower guide 59 for limiting vertical movement of the intermediate nozzle 30. A cup-shaped suction member or nozzle 34, having a bottom, is axially slidably fitted over a lower portion of the intermediate nozzle 30, the bottom having a plurality of suction slots or ports 33. The suction nozzle 34 is normally urged downwardly by a compression coil spring 35 acting between the bottom of the suction nozzle 34 and a shoulder or step 27A defined in the guide nozzle 26 around its central bore 27, the compression coil spring 35 extending through the intermediate nozzle 30. The suction nozzle 34 is prevented from dropping off and is limited in its angular motion with respect to the intermediate nozzle 30 by a limitation member 37 extending between the flange 32 of the intermediate nozzle 30 and an annular flange 36 disposed at an upper end of the suction nozzle 34. The limitation member 37 is in the form of a pin having an upper end pivotably mounted on the flange 32 and a lower end extending through the flange 36 and having a stopper engaging therewith. The intermediate nozzle 30 is movable upwardly and downwardly with respect to the sucker frame 21 while being prevented from angular movement by a guide plate or key 38 attached to the sucker frame 21.

A bearing 39 is fitted in each of the side walls 21A, 21B of the sucker frame 21 and positioned upwardly of the nozzle support 23. The bearing 39 receives therein an adjustment knob 41 having a bore 40 which is located off center with respect to the bearing 39 by a distance t (FIG. 5). The adjustment knob 41 is angularly movable in the bearing 39 and serves to adjust the position of the suction nozzle 34 in the back-and-forth direction. A rod 43 extends through the bore 40 and has on an outer end a grip 42 secured thereto and a threaded inner end portion 44. The rod 43 also has a flange disposed between the grip 42 and the threaded inner end portion 44. With the grip 42 and the flange positioned one on each side of the adjustment knob 41, the rod 43 is prevented from being axially displaced. The rod 43 serves to adjust the position of the suction nozzle 34 in the lateral direction transverse to the back-and-forth direction. The guide nozzle 26 has on its upper end a U-shaped retainer 26 having a transverse U-shaped slot 46, as shown in FIG. 2, in which there is disposed a nut 47, having an internally threaded hole, which is angularly movable in the retainer 26 and along the U-shaped slot 46. The threaded inner end portion 44 of the rod 43 threadedly extends through the internally threaded hole in the nut 47. The rod 43 is frictionally braked against smooth rotation by a stop 49 mounted in the nut 47 and retained therein by a setscrew 48. The rod 43 has on its end 43A remote from the grip 42 a collar 50 affixed thereto to determine a terminal position for angular motion of the guide nozzle 26. The adjustment knob 41 is also frictionally braked against smooth rotation by a stop 51 mounted in the bearing 39.

Figure 7:
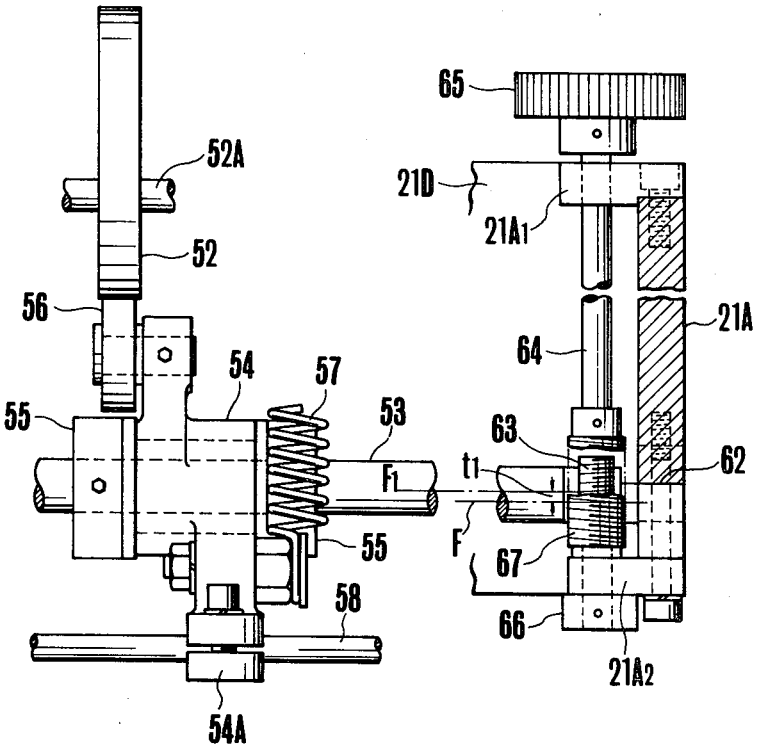
FIG. 7 is a cross-sectional view taken along line VII—VII of FIG. 3.

As shown in FIGS. 2 and 7, a cam 52 is supported on a cam shaft 52A extending between the side walls 21A, 21B of the sucker frame 21 and is rotatable in synchronization with suction by the suction members 34 on the sheets 22, one at a time. A lever shaft 53 is supported by the side walls 21A, 21B for angular movement about its own axis, and is positioned downwardly of the cam 52. An L-shaped cam lever 54 is angularly movably fitted over the lever shaft 53 and is prevented from axial movement by a collar 55 mounted on the lever shaft 53. The cam lever 54 has on one distal end a cam follower 56 held against a cam surface of the cam 52. A tension spring 57 acts between a front member 21C of the sucker frame 21 and a lever arm of the cam lever 54 to normally urge the cam follower 56 into pressed engagement with the cam surface of the cam 52. A guide rod 58 is attached to a distal end 54A of the cam lever 54 and has on each of its axial ends the lower guide 59 which cooperates with the upper guide 61 in sandwiching the flange 32 of each intermediate cylindrical nozzle 30. Each of the ends of the guide rod 58 also supports a guide support 60 fixedly mounted thereon adjacent to the lower guide 59 and mounting thereon the upper guide 61.

As shown in FIGS. 3 and 7, the lever shaft 53 has axial ends 62 journalled respectively in the side walls 21A, 21B of the sucker frame 21, each end 62 being disposed off center by a distance $t_1$ with respect to a boss of the cam lever 54 which fits over the lever shaft 53. One of the eccentric axial ends 62 which extends inwardly of the sucker frame 21 supports thereon a worm wheel 63. A worm shaft 64 extends vertically between and is rotatably supported by upper and lower members 21A1, 21A2 projecting inwardly from the side wall 21A adjacent to the worm wheel 63, the worm shaft 64 being prevented from being axially displaced by a knob 65 and a collar 66 which are mounted respectively on ends of the worm shaft 64. The worm shaft 64 supports a worm 67 secured coaxially thereto and held in mesh with the worm wheel 63. Rotation of the worm shaft 64 causes the lever shaft 53 to turn, thus enabling an axis F1 of the latter to turn around an axis F of the axial end 62 journalled in the side wall 21A. The worm wheel 63 is related in angular phase to the lever shaft 53 such that the axis F1 of the latter will be angularly movable for equal intervals one on each side of a center line of the cam lever 54 (FIG. 3) upon rotation of the worm shaft 64. When the lever shaft 53 is thus angularly moved, an axis of the boss of the cam lever 54 is angularly displaced to thereby move the upper and lower guides 61 and 59 upwardly or downwardly, whereupon the fixed position for the intermediate cylindrical nozzles 30 is displaced upwardly or downwardly.

Figure 6:
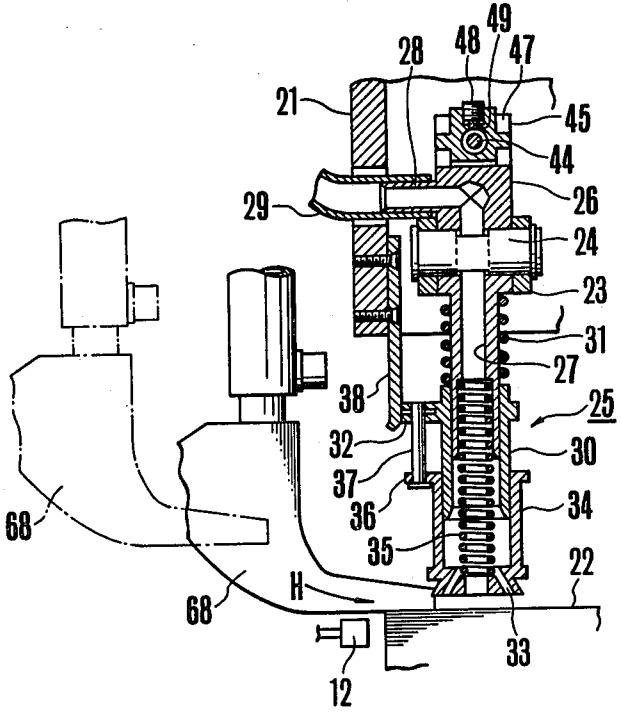
FIG. 6 is a cross-sectional view taken along line VI—VI of FIG. 2.

As illustrated in FIG. 6, a probing foot 68 is disposed adjacent to each of the suction nozzles 34 and is movable in the direction of the arrow H from a retracted position shown by the broken lines to an advanced position shown by the solid lines. The air blower 12 is also disposed adjacent to each of the suction nozzles 34 and the stacked sheets 22. The probing foot 68 and the air blower 12 are of the same construction as that of the conventional probing foot and air blower as shown in FIG. 1, and hence will not be described in detail. Furthermore, the paper feeder of the present invention also includes transport suction devices, and timing and transport rollers (not shown) which are of the same structure as that of the corresponding parts as illustrated in FIG. 1, and no description thereof will be given.

The paper feeder thus constructed will operate as follows. First, a stacked pile of sheets of paper 22 is loaded on the table, and the air blowers 12 are actuated to blow air streams against an upper portion of the sheet stack for facilitating separation between the sheets 22. At this time, the cam follower 56 is held against a larger-diameter portion of the cam 52, and hence the intermediate nozzles 30 are in the lower position, with the upper and lower guides 61, 59 which sandwich the flanges 32, being lowered by the cam lever 54 and the guide rod 58. The suction nozzles 34 are lowered under the resiliency of the inner springs 35. Operation of the printing machine with which the paper feeder is associated is now started. Air is drawn through the air hoses 29 to attract the topmost sheet 22 to the bottoms of the suction nozzles 34, thus closing the suction ports 33 therein, whereupon a vacuum is developed in the suction nozzles 34 and the central bores 27. The inner springs 35 are compressed under the atmospheric pressure, causing the suction nozzles 34 to move upwardly with the sheet 22 attracted thereto. When the suction nozzles 34 stop, upon engagement of their flanges 36 with the flanges 32 of the intermediate nozzles 30, the probing foot 68 moves onto the next sheet of paper 1 and presses down the stack of sheets of paper 1 to prevent the latter from flying up. At this time, since the cam follower 56 reaches a smaller-diameter portion of the cam 52, the upper and lower guides 61, 59 on the guide rod 58 are moved upwardly to cause the intermediate nozzle 30 and the suction nozzle 34 to ascend in unison as they compress the outer and inner springs 31, 35. When the intermediate nozzle 30 and the suction nozzle 34 reach their uppermost position, the probing foot 68 discharges air against the entire underside of the raised sheet 22, which is then caused to float over the piled sheets 22. The transport suction devices (not shown) are now actuated to attract the floating sheet 22, and the separation suction devices 25 are inactivated, whereupon the interior of the suction nozzles 34 approaches the atmospheric pressure. The suction nozzles 34 descend rapidly under the force of the inner spring 35 to lower the picked-up sheet, which is allowed to be released from the suction nozzles 34. Thereafter, the transport suction devices transfer the sheet 22 away from the separation suction devices 25 toward the timing and transport rollers. The probing foot 68 returns to its retracted position upon downward movement of the separation suction devices 25. One cycle of paper feeding operation is completed when the intermediate nozzles 30 are caused to descend by the cam 52.

During the foregoing paper feeding operation, the picked-up sheet 22 tends to fly up when the suction nozzles 34, on their upward movement, impinge on the flanges 32 of the intermediate nozzles 30. A current of air is introduced by such flying of the picked-up sheet 22 from the trailing edge thereof toward the center thereof. When the intermediate nozzles 30 reach their uppermost position with the outer and inner springs 31, 35 compressed, the sheet 22 is caused to fly up again allowing an air current to reach the leading edge portion of the sheet 22. The sheet 22 is lifted by the intermediate nozzles 30 and the suction nozzles 34 as they are moved an under the atmospheric pressure. Such movement of the nozzles 30 and the nozzle 34 under pressure can be effected rapidly and smoothly, permitting high-speed operation of the paper feeder while controlling motion of the picked-up sheet 22. When the sheet 22 is to be transferred to the transport suction devices, the separation suction devices 25 are deactivated to allow the suction nozzles 34 to move the sheet 22 rapidly down under the bias of the springs 35, 31. Thus, the sheet 22 can readily be separated from the separation suction devices 25 without getting skewed slightly out of alignment with other sheets 22.

When it is necessary to correct the sheets 22 into the proper orientation or tension widthwise while the sheets 22 are picked up one at a time by the separation suction devices 25, the latter are adjusted in their angle of inclination. Such adjustment will be carried out as follows: During operation of the paper feeder, the knob 41 is turned while observing the way the sheets 22 are attracted upwardly one by one. Since the bore 40 in the knob 41 is disposed off center with respect to the knob 41 itself, the adjustment rod 43 in the bore 40 turns about the axis of the knob 41 upon angular movement of the latter, causing the separation suction device 25 coupled to the rod 43 by the nuts 47 to be tilted back and forth. Thus, the angle of inclination of the separation suction device 25 in the back-and-forth direction is adjusted by the knob 41. Turning movement of the grip 42 on the rod 43 causes the nut 47 to move on and along the threaded inner portion 44 of the rod 43, whereupon the separation suction device 25, coupled to the nut 47 through the U-shaped slot 46, is tilted in the lateral direction. Therefore, the angle of inclination of the separation suction device 25 in the transverse direction is adjusted by the grip 42. With the separation suction devices 25 thus adjusted, they move upwardly at the adjusted angles of inclination while carrying the sheet 22 attracted to the suction nozzles 34, so that the sheet 22 will be corrected in its orientation and kept taut widthwise when transferred to the transport suction devices. The foregoing adjustment can be made while observing the way the picked-up sheet 22 is carried by the separation suction devices 25, with the results that the adjustment can be carried out precisely, quickly, and with ease.

For feeding sheets 22 of different thicknesses or grades, the knob 65 is turned to cause the lever shaft 53 to be angularly moved by the worm 67 and the worm wheel 63 meshing therewith in such a manner that the axis F1 of the lever shaft 63 turns through an arc around the axis of the axial shaft end 62. The upper and lower guides 61, 59 on the guide rod 58 supported on the distal end 54A of the cam lever 54 are moved mainly vertically together with the cam lever 54, resulting in a displacement of the upper and lower limit positions for the intermediate nozzles 30 with their flanges 32 sandwiched between the upper and lower guides 61, 59, and hence the suction nozzles 34. Thus, the distance between the lower surfaces of the suction nozzles 34 and the topmost surface of the stacked sheets 22 is adjusted by the knob 65. Such an adjusting operation can be effected quickly while the paper feeder is in operation. The adjustment involves no change in relative positional relationship between the timing and transport rollers and air blower, and the stacked pile of sheets 22. Paper feeding operation during the adjusting process is not impaired.

Since the range in which the cam lever 54 is angularly adjustable is determined such that the axis F1 is displaceable for equal intervals on both sides of the center line F, as shown in FIG. 3, the cam lever 54 moves along center line F only for a small distance even if the lever shaft 54 is fully turned within the adjustment range. A resulting variation in phase relationship between the cam 52 and the cam follower 56 is negligible and does not adversely affect the timing with which the separation suction devices 25 move upwardly and downwardly.

An inner spring 35, which is shorter than that shown may be disposed to act between a lower end of the intermediate nozzle 30 and the suction nozzle 34. For uniform application of spring forces to the suction nozzle 34 on an upward stroke thereof, however, the inner spring 35 as illustrated should preferably be used.

With the arrangement according to the embodiment shown in FIGS. 2 through 7, the separation suction devices 25 can be adjusted to control the orientation of the picked-up sheet 22 while the paper feeder is in operation. The suction nozzles 34 are upwardly movable in two stepped motions to fly the attracted sheet 22 for introducing an air current therebelow, so that the picked-up sheet 22 can easily be separated from the pile of stacked sheets 22. Downward movement of the suction nozzles 34 under the resiliency of the springs 35 causes the sheet 22 to be lowered for smooth and reliable separation thereof from the suction nozzles 34 upon transfer of the sheet 22 to the transport suction devices. The distance between the suction nozzles 34 and the surface of the topmost sheet 22 can be adjusted precisely and quickly while observing the manner in which the picked-up sheet 22 is attracted by the separation suction devices 25 during operation of the paper feeder. No sheet of paper is wasted on a trial basis during such adjustment. The above adjustment accompanies no change in relative positional relationship between the stacked sheets 22 and the rollers, the probing foot and the air blower, as only the separation suction devices 25 are positionally adjusted. Since no adjusting mechanism is necessary for the probing foot, the latter can be lighter in weight and hence is movable more smoothly for high-speed operation and improved performance.

Figure 9:
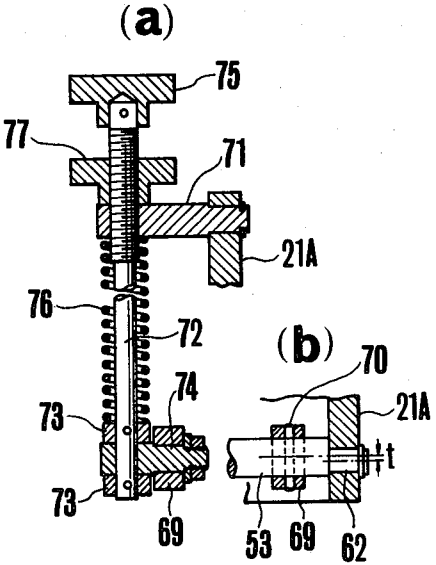
FIG. 9(*a*) is a cross-sectional view taken along line IX—IX of FIG. 8.
Figure 8:
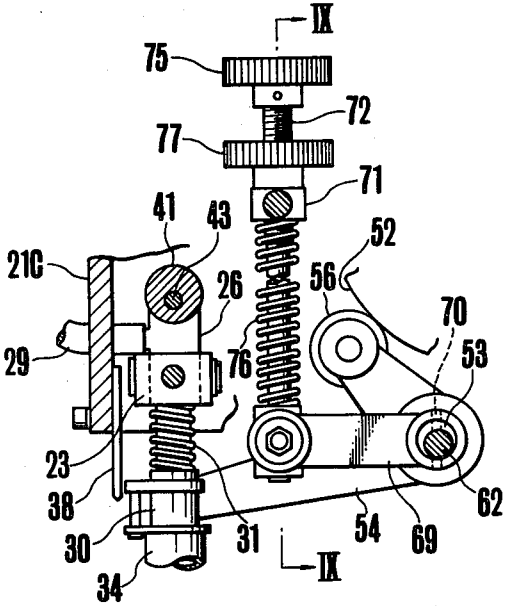
FIG. 8 is a front elevational view of a means for angularly moving a lever shaft according to another embodiment of the present invention.

According to another embodiment shown in FIGS. 8, 9(*a*) and 9(*b*), a swing lever 69 is secured to a lever shaft 53 by a lock pin 70. A bracket 71 is mounted on the sucker frame 21 for angular movement about its own axis and supports thereon a shaft 72 having a threaded portion threaded through the bracket 71 for axial movement thereof. The shaft 72 supports on its lower end a coupling pin 74 fitted thereon and prevented from axial movement by collars 73. The swing lever 69 has a distal end pivotably mounted on the coupling pin 74. The shaft 72 has on its upper end a knob 75 secured thereto. A compression coil spring 76 is disposed around the shaft 72 and between the collars 73 and the bracket 71 for normally urging the swing lever 69 and the cam lever 54 downwardly in the direction in which the intermediate nozzle 30 moves downwardly. A knob 77 is threaded over the threaded portion of the shaft 72 to adjust and fix the shaft 72 with respect to the bracket 71. Upon loosening of the knob 77 away from the bracket 71, the knob 75 is turned to angularly move the shaft 72 about its own axis to enable the swing lever 69 to turn the lever shaft 53 about its own axis, whereupon the cam lever 54 mounted on the lever shaft 53, arranged off center with respect to the axial end 62 journalled in the side wall 21A, is displaced vertically to change the upper and lower limits for the intermediate nozzles 30.

Although certain preferred embodiments have been shown and described in detail, it should be understood that various changes and modifications may be made therein without departing from the scope of the appended claims.

What is claimed is:

1. A paper feeder comprising a frame, a separation suction device mounted on said frame and substantially vertically movable for picking up stacked sheets one at a time, and a transport suction device mounted on said frame and substantially horizontally movable for transferring the picked-up sheet from said separation suction device, said separation suction device including a hollow guide nozzle supported on said frame and tiltable in a back-and-forth direction and an orthogonal direction, a hollow intermediate nozzle telescopically fitted over said guide nozzle and resiliently urged to move downwardly, said hollow intermediate nozzle having a flange, a hollow suction nozzle telescopically fitted over said hollow intermediate nozzle and resiliently urged to move downwardly, said hollow suction nozzle being operatively coupled to said intermediate nozzle and including a bottom having a suction port, an adjusting mechanism interposed between said frame and said guide nozzle for tilting said guide nozzle to adjust angles of inclination thereof in said back-and-forth and orthogonal directions, a first guide member vertically movably supported on said frame and vertically restricting said flange of said intermediate nozzle, and a cam mechanism mounted on said frame and operable in synchronization with said separation and transport suction devices, said first guide member being limited in its vertical position by said cam mechanism wherein said cam mechanism comprises a lever shaft having an axial end journalled in said frame and having an eccentric portion disposed off center with respect to said axial end, a cam lever supported on said eccentric portion and including a lever end having a second guide member held in engagement with said first guide member, a cam rotatably mounted on said frame and rotatable in synchronization with said separation suction device, a cam follower mounted on said cam lever and held against said cam, and means on said frame for angularly moving said cam lever about an axis of said axial end to adjust vertical positional limits for said first guide member.

2. A paper feeder according to claim 1, wherein said means comprises a worm wheel mounted on said lever shaft in concentric relation to said axial end, a shaft supported on said frame for angular movement about its own axis, and a worm mounted coaxially on said shaft and held in driving mesh with said worm wheel.

3. A paper feeder according to claim 1, wherein said means comprises a swing lever mounted on said lever shaft and having a distal end, a support mounted on said frame, and a shaft having a threaded portion threaded through said support for axial movement of said shaft, and an end to which said distal end of said swing lever is angularly movably coupled.

* * * * *